US005273672A

United States Patent [19]

Dasai et al.

[11] Patent Number: 5,273,672

[45] Date of Patent: * Dec. 28, 1993

[54] LUBRICATING OIL COMPOSITION CONTAINING A PARTIAL ESTER OF A POLYHYDRIC ALCOHOL AND A SUBSTITUTED SUCCINIC ACID ESTER

[75] Inventors: Masashi Dasai; Tsutomu Akita; Masaharu Sasaki, all of Ichihara, Japan

[73] Assignee: Idemitsu Kosan Company Limited, Tokyo, Japan

[ * ] Notice: The portion of the term of this patent subsequent to Oct. 11, 2005 has been disclaimed.

[21] Appl. No.: 682,882

[22] Filed: Apr. 8, 1991

Related U.S. Application Data

[63] Continuation of Ser. No. 274,146 filed as PCT/JP88/00221 on Feb. 29, 1988, abandoned.

[30] Foreign Application Priority Data

Mar. 2, 1987 [JP] Japan ..... 62-47396

[51] Int. Cl.[5] ..... C10M 129/76

[52] U.S. Cl. ..... 252/56 R; 252/48.6; 252/49.6; 252/51.5 A; 252/79

[58] Field of Search ..... 252/56 D, 49.6, 56 R, 252/79, 48.6, 51.5 A

[56] References Cited

U.S. PATENT DOCUMENTS

| | | | |
|---|---|---|---|
| 2,515,115 | 10/1947 | Davis et al. | 252/56 R |
| 2,561,659 | 7/1951 | Rudel et al. | 252/560 |
| 2,603,604 | 7/1952 | Ballard et al. | 252/48.6 |
| 2,683,119 | 7/1954 | Smith, Jr. et al. | 252/48.6 |
| 2,775,560 | 12/1956 | Lurton et al. | 252/56 R |
| 2,962,443 | 11/1960 | Rhodes | 252/56 D |
| 3,184,408 | 5/1965 | Wilson et al. | 252/56 R |
| 3,235,499 | 2/1966 | Waldmann | 252/56 R |
| 3,381,022 | 4/1968 | Le Suer . | |
| 3,403,092 | 9/1968 | Rausch | 208/36 |
| 3,658,707 | 4/1972 | Delafield et al. | 252/56 R |

(List continued on next page.)

FOREIGN PATENT DOCUMENTS

| | | |
|---|---|---|
| 021838 | 6/1980 | European Pat. Off. . |
| 1544802 | 11/1968 | France . |
| 2229760 | 12/1974 | France . |
| 1095 | 1/1985 | Japan . |
| 19698 | 1/1986 | Japan . |
| 1199936 | 7/1970 | United Kingdom . |
| 2097813 | 4/1982 | United Kingdom . |

OTHER PUBLICATIONS

"Sekiyu Seihin Tenkazai" Sakurai Toshio (author) Aug. 10, 1974 [p. 224, line 24 to p. 225, line 9 from the bottom].

*Primary Examiner*—Jerry D. Johnson

*Attorney, Agent, or Firm*—Frishauf, Holtz, Goodman & Woodward

[57] ABSTRACT

The present invention provides a lubricating oil composition characterized in that the base oil contains (A) from 0.05 to 5% by weight of an ester of alkenyl substituted succinic acid and/or an ester of alkyl substituted succinic acid and (B) from 0.005 to 5% by weight of a fatty acid ester of a polyhydric alcohol. The lubricating oil composition of the present invention has a friction characteristic in which the (coefficient of static friction)/(coefficient of dynamic friction) ratio is small and gives only a small shock by shift change. In addition, the changes in the friction characteristics depending on the oil temperature is small and also the changes in the lapse of time are small. Accordingly, it is fully compatible with the trend toward a compact size of transmissions and the like. Accordingly, the lubricating oil composition of the present invention is very effective as a lubricating oil for automatic transmissions, lubricating oil for the parts having a wet-type clutch or wet-type brake as in tractors and the like, and so on.

30 Claims, 3 Drawing Sheets

U.S. PATENT DOCUMENTS

| | | | |
|---|---|---|---|
| 3,720,615 | 3/1973 | Izumi et al. | 252/56 R |
| 3,915,843 | 10/1975 | Franck et al. | 208/112 |
| 3,933,659 | 1/1976 | Lyle et al. | 252/427 |
| 3,962,071 | 6/1976 | Itoh et al. | 208/58 |
| 4,209,411 | 6/1980 | Winans et al. . | |
| 4,256,593 | 3/1981 | Nozawa | 208/18 |
| 4,304,678 | 12/1981 | Schick et al. | 252/56 R |
| 4,336,149 | 6/1982 | Erdman | 252/56 R |
| 4,372,839 | 2/1983 | Oleck et al. | 208/59 |
| 4,376,036 | 3/1983 | Garwood et al. | 208/111 |
| 4,376,056 | 3/1983 | Erdman | 252/56 R |
| 4,491,527 | 1/1985 | Lange et al. | 252/56 R |
| 4,589,993 | 5/1986 | Cleveland et al. | 252/79 |
| 4,664,822 | 5/1987 | Hunt et al. | 252/32.7 E |
| 4,683,069 | 7/1987 | Brewster et al. | 252/56 R |
| 4,767,551 | 8/1988 | Hunt et al. | 252/32.7 E |
| 4,800,029 | 1/1989 | Dasai | 252/56 R |
| 4,960,542 | 10/1990 | Seiki | 252/56 R |
| 4,968,452 | 11/1990 | Seiki | 252/56 R |
| 4,968,453 | 11/1990 | Wada et al. | 252/56 R |
| 5,064,546 | 11/1991 | Dasai | 252/32.5 |

LUBRICATING OIL COMPOSITION CONTAINING A PARTIAL ESTER OF A POLYHYDRIC ALCOHOL AND A SUBSTITUTED SUCCINIC ACID ESTER

This application is a continuation of application Ser. No. 07/274,146, filed Sep. 30, 1988, now abandoned.

FIELD OF TECHNOLOGY

The present invention relates to a lubricating oil composition or, more particularly, relates to a lubricating oil composition which can be used satisfactorily for the lubrication of parts having a wet-type clutch or wet-type brake such as automatic transmission, tractors and the like.

BACKGROUND TECHNOLOGY

Lubricating oils used for the lubrication of the parts having a wet-type clutch or wet-type brake such as automatic transmissions, tractors and the like are required have properties including good friction characteristic, oxidation stability, corrosion resistance and rustpreventiveness as well as a large torque for power transmission. The friction characteristic here implied is a ratio of the coefficient of static friction and the coefficient of dynamic friction and it is required that this ratio is small and little influenced by the changes in the temperature or in the lapse of time.

In the prior art, there is known such a lubricating oil having a large coefficient of static friction and a good torque for power transmission. This lubricating oil, however, has defects that the friction characteristic thereof is not satisfactory so that a shift of the automatic transmission and the like causes a large shock.

In particular, the trend is more and more outstanding in recent years that automatic transmissions and the like are designed in a decreased size along with the prevalence of compact cars and so-called FF cars (front engine, front wheel driven cars). This trend of automatic transmissions toward compact size promotes the adverse influence that the shift shock is felt sensitively by the driver. Accordingly, it is a technical problem to further improve the friction characteristics in order to improve the comfortableness of driving by decreasing the shift shock.

A proposal has been made accordingly of a lubricating oil by use of a friction modifier with an object of improving the friction characteristics. There is a problem, however, that the lubricating oil containing a friction modifier still has only insufficient friction characteristics along with variation of the friction characteristics by the change in the oil temperature and that the friction characteristics are subject to decrease by the degradation (changes in the lapse of time) of the oil after a long-term service.

Therefore, lubricating oils having good friction characteristics with small changes by oil temperature and in the lapse of time and having a large transmission torque have hitherto not been obtained.

The object of the present invention is to dissolve the above described problems in the prior art by a specific combination of compounds contained in a base oil and to provide a lubricating oil composition with a small shock and a large transmission torque and capable of being satisfactorily used for lubrication of automatic transmissions and the like.

DISCLOSURE OF THE INVENTION

Namely, the present invention relates to a lubricating oil composition characterized in that a base oil contains (A) from 0.05 to 5% by weight of an ester of alkenyl substituted succinic acid and/or an ester of alkyl substituted succinic acid and (B) from 0.005 to 5% by weight of a fatty acid ester of a polyhydric alcohol.

The lubricating oil composition of the present invention has a good friction characteristic or, namely, a small (coefficient of static friction)/(coefficient of dynamic friction) ratio and gives a small shift shock. In addition, the change in the friction characteristics depending on the oil temperature is small, and also the changes in the lapse of time are small so that it is fully adaptable to the trend of transmissions and the like toward compact size.

BEST MODE EMBODIMENT TO PRACTICE THE INVENTION

Figure 1:
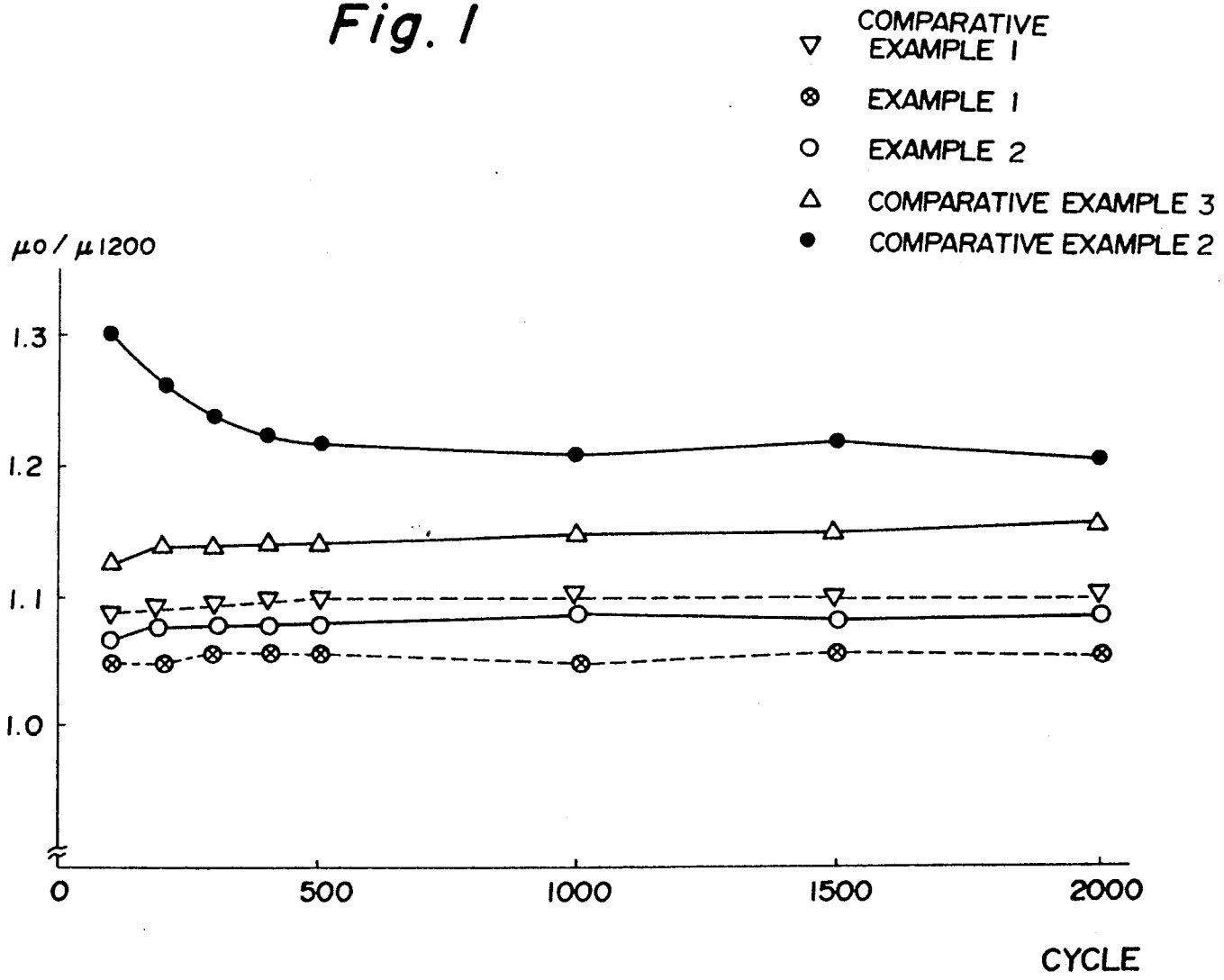
FIG. 1 and FIG. 3 are each a graph showing the change in time of $\mu_0/\mu_{1200}$ at each time up to 2000 cycles in Examples and Comparative Examples and FIG. 2 is a graph showing the temperature change thereof.

The base oil used in the present invention is the principal ingredient of the lubricating oil composition and various kinds of mineral oils and/or synthetic oils can be used among those used in conventional lubricating oils.

The base oil should preferably have a viscosity of 1.5 to 30 centistokes at 100° C. and, in particular, those of 2 to 20 centistokes are preferred when used as an oil for automatic transmissions and an oil for wet-type brakes in agricultural tractors.

To show particular examples of the base oil, the mineral oils include 60 neutral oil, 100 neutral oil, 150 neutral oil, 300 neutral oil , 500 neutral oil and the like by solvent refining or hydrogenation refining.

On the other hand, the synthetic oils include polyolefins, polyglycol esters, esters of dibasic acids, polyol esters, phosphoric acid esters, silicone oils, alkyl benzenes, alkyl diphenyls and the like as well as condensed ring and/or non-condensed ring saturated hydrocarbons and those mainly composed thereof can be used as the base oil.

When a mineral oil is used as the base oil in the present invention, incidentally, various ones can be used provided that the kinematic viscosity at 100° C. is from 1.5 to 30 centistokes or, preferably, from 2 to 20 centistokes and those to be used preferably should contain 0.5% by weight or less or, more preferably, 0.1% by weight or less or, particularly preferably, 100 ppm or less of sulfur.

An excess amount of the sulfur over 0.5% by weight is not preferable here due to the decrease in the oxidation stability.

Mineral oils having a low pour point can also be used. It should have a pour point of, preferably, −15° C. or below or, more preferably, −25° C. or below or, particularly preferably, −35+ C. or below. This is because the friction characteristics can be further improved along with mitigation of the limitation relative to the temperature range for use.

Incidentally, the preferable conditions for the mineral oil are that the content of aromatic hydrocarbons (% $C_A$) is 20 or smaller or, more preferably, 10 or smaller, that the total acid value is 0.1 mg KOH/g or smaller or, preferably, 0.05 mg KOH/g or smaller, and so on.

Mineral oil having the properties as described above can be obtained by refining a distillate (boiling point under atmospheric pressure, about 250°–450° C.) as obtained by distillation of paraffin base crude oil, intermediate base crude oil or naphthene base crude oil, by the usual method, or by applying deep dewaxing treatment to thus obtained oil.

The distillate means an oil obtained either by atmospheric distillation of crude oil or by vacuum distillation of residual oil resulting from atmospheric distillation of crude oil. A method of refining is not critical, and any of the methods (1) to (5) as described below can be employed.

(1) The distillate is subjected to hydrogenation treatment, or alternatively, after hydrogenation treatment, the distillate is subjected to alkali distillation or sulfuric acid washing (treating).

(2) The distillate is subjected to solvent refining treatment, or alternatively, after solvent refining treatment, the distillate is subjected to hydrogenation treatment, alkali distillation or sulfuric acid washing (treating).

(3) The distillate is subjected to hydrogenation treatment followed by second hydrogenation treatment.

(4) The distillate is subjected to hydrogenation treatment, then to second hydrogenation treatment, and further to third hydrogenation treatment.

(5) The distillate is subjected to hydrogenation treatment followed by second hydrogenation treatment, and further to alkali distillation or sulfuric acid washing (treating).

One of the methods will hereinafter be explained.

A crude starting material for lubricating oil is produced from paraffin base crude oil or intermediate base crude oil by the usual method and then is subjected to a severe hydrogenation treatment. In this treatment, undesirable components, such as aromatics, for the lubricating oil fraction are removed or converted into useful components. Almost all of the sulfur and nitrogen components are removed at the same time.

Such fractional distillation as to obtain the necessary viscosity is carried out by vacuum distillation. Then, the known solvent dewaxing treatment is carried out so as to dewax to the pour point that the usual paraffin base oil has, that is, about −15° to −10° C.

After the dewaxing treatment, if necessary, hydrogenation is carried out to hydrogenate the major portion of aromatic components into saturated components, the thereby increasing thermal and chemical stability of the base oil. When the thus obtained mineral oil is insufficient because the poor point is still high, a deep dewaxing treatment can be applied subsequently. For this treatment, there are employed a solvent dewaxing method which is carried out under severe conditions, and a catalytic hydrogenation dewaxing method in which a zeolite catalyst is used and paraffin (mainly n-paraffin) adsorbed on the fine pores of the catalyst is selectively decomposed under a hydrogen atmosphere to remove components to be converted into wax components.

Conditions for hydrogenation treatment vary with the properties, etc. of the feed oil. Usually, the reaction temperature is 200° to 480° C. and preferably 250° to 480° C., the hydrogen pressure is 5 to 300 kg/cm$^2$ and preferably 30 to 250 kg/cm$^2$, and the amount of hydrogen introduced (per kiloliter of the fed distillate) is 30 to 3,000 Nm$^3$ and preferably 100 to 2,000 Nm$^3$. In this hydrogenation treatment, there are used catalysts which are prepared by depositing catalyst components such as Groups VI, VIII group metals, preferably cobalt, nickel, molybdenum and tungsten on carriers such as alumina, silica, silica alumina, zeolite, active carbon and bauxite using the known method. It is preferred that the catalyst be previously subjected to preliminary sulfurization.

As described above, after hydrogenation treatment, the distillate is subjected to various treatments. When a second hydrogenation treatment or further a third hydrogenation treatment is applied, the treatment may be carried out under conditions falling within the ranges as described above. Conditions at the first, second and third stage hydrogenation treatments may be the same or different. Usually the second hydrogenation treatment is carried out under more severe conditions than the first stage hydrogenation treatment, and the third stage hydrogenation treatment, under more severe conditions than the second stage hydrogenation treatment.

Alkali distillation is carried out as a step where small amounts of acidic substances are removed to improve the stability of distillate. In this alkali distillation, alkalis such as NaOH and KOH are added and vacuum distillation is conducted.

Sulfuric acid washing (treating) is generally carried out as a finishing step of oil products, in which aromatic hydrocarbons, especially polycyclic aromatic hydrocarbons, olefins, sulfur compounds, etc. are removed to improve the characteristics of distillate. In the present invention, 0.5 to 5% by weight of concentrated sulfuric acid is added to the distillate, the treatment is carried out at a temperature ranging between room temperature and 60° C., and thereafter neutralization using NaOH, etc. is applied.

The aforementioned methods (1) to (5) to be employed in the treatment of distillate comprise combinations of the operations as described above. Of these methods, the methods (1), (3) and (4) are particularly suitable.

The distilled oil obtained by the treatment described above has properties including a kinematic viscosity of 1.5 to 30 centistokes (100° C.), content of sulfur of 0.5% by weight or less and pour point of −15° C. or below. Also, the content of the aromatic hydrocarbons (% $C_A$) is 20% or smaller and the total acid value is 0.1 mg KOH/g or smaller.

The use of such a mineral oil can provide a lubricating oil composition having a smaller (coefficient of static friction)/(coefficient of dynamic friction) ratio.

And, preferable synthetic oils include polyolefins and condensed ring and non-condensed ring saturated hydrocarbons.

Among various ones named as such a saturated hydrocarbon, saturated hydrocarbons having a cyclohexyl group and/or a decalyl group and having 10 to 40 carbon atoms are preferred. The saturated hydrocarbons having a cyclohexyl group and/or a decalyl group here are exemplified particularly by 2-methyl-2,4-dicyclohexyl pentane, cyclohexyl methyl decalin, 1-(methyl decalyl)-1-cyclohexyl ethane, 2,4-dicyclohexyl pentane, isododecyl cyclohexane and the like.

The base oil can be admixed according to need with a viscosity index improver, corrosion inhibitor and the like.

In the present invention, an ester of alkenyl substituted succinic acid and/or an ester of alkyl substituted succinic acid are used as the component (A). The ester of alkenyl substituted succinic acid or ester of alkyl substituted succinic acid can be used particularly efficiently when it is represented by the general formula [I] given below.

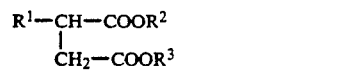

$$R^1-CH(CH_2-COOR^3)-COOR^2 \quad [I]$$

In the above given formula [I], $R^1$ is an alkenyl group or an alkyl group having 6 to 30 carbon atoms or, preferably, 12 to 24 carbon atoms.

And, $R^2$ and $R^3$ in the above given formula [I] are each a hydrogen, an alkyl group having 1 to 20 carbon atoms, a hydroxyalkyl group having 1 to 20 carbon atoms or a group represented by the general formula

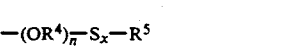

$$-R^4-(OR^4)_n-S_x-R^5$$

(in the formula $R^4$ is an alkylene group having 1 to 4 carbon atoms, $R^5$ is an alkyl group having 1 to 20 carbon atoms or a hydroxy-substituted group thereof, n is an integer of 0 to 6 and x is 1 or 2).

$R^2$ and $R^3$ here can be the same ones or different from each other excepting the case where $R^2$ and $R^3$ are both hydrogens.

Particular examples of the ester of alkenyl substituted succinic acid and ester of alkyl substituted succinic acid include monomethyl ester of octadecenyl succinic acid, dimethyl ester of octadecenyl succinic acid, monoethyl ester of octadecenyl succinic acid, diethyl ester of octadecenyl succinic acid, monooctyl ester of octadecenyl succinic acid, dioctyl ester of octadecenyl succinic acid, monononyl ester of octadecenyl succinic acid, dinonyl ester of octadecenyl succinic acid, monolauryl ester of octadecenyl succinic acid, dilauryl ester of octadecenyl succinic acid, monolauryl ester of dodecyl succinic acid, dilauryl ester of dodecyl succinic acid, monomethyl ester of hexadecyl succinic acid, dimethyl ester of hexadecyl succinic acid, monoethyl ester of hexadecyl succinic acid, diethyl ester of hexadecyl succinic acid, monomethyl ester of octadecyl succinic acid, dimethyl ester of octadecyl succinic acid, monoethyl ester of octadecyl succinic acid, diethyl ester of octadecyl succinic acid, monooctyl ester of octadecyl succinic acid, dioctyl ester of octadecyl succinic acid, monolauryl ester of octadecyl succinic acid, monolauryl ester of octadecyl succinic acid, dilauryl ester of octadecyl succinic acid, a reaction product of an alkenyl succinic acid of a propylene oligomer having 18 carbon atoms on an average and a propylene glycol, a reaction product of a polybutenyl succinic acid of a polybutene having an average molecular weight of 400 and a propylene glycol, octyl mercaptan ethylene oxide ester of octadecenyl succinic acid, octyl mercaptan propylene oxide ester of octadecenyl succinic acid, nonyl mercaptan ethylene oxide ester of octadecenyl succinic acid, nonyl mercaptan propylene oxide ester of octadecenyl succinic acid, lauryl mercaptan ethylene oxide ester of octadecenyl succinic acid, lauryl mercaptan propylene oxide ester of octadecenyl succinic acid, 5-hydroxy-3-thiapentyl ester of octadecenyl succinic acid, 6-hydroxy-3,4-dithiahexyl ester of octadecenyl succinic acid and the like.

In the present invention, either one of the ester of alkenyl substituted succinic acid and the ester of alkyl substituted succinic acid or a mixture thereof is added as the component (A) while the amount of addition thereof depends on the properties of the desired lubricating oil composition and the like and cannot be definitely selected. It is, however, usually from 0.05 to 5.0% by weight or preferably from 0.1 to 3.0% by weight. No sufficient effect can be obtained with an amount of addition smaller than 0.05% by weight while an undesirably adverse decrease is caused in the oxidation stability with an excess over 5.0% by weight.

In the next place, a fatty acid ester of a polyhydric alcohol is used as the component (B) in the present invention. The polyhydric alcohol here implied includes glycerin, trimethylol propane, pentaerithritol, sorbitol and the like, of which glycerin is particularly preferable. And, the fatty acid includes those having 8 to 30 carbon atoms which may be either saturated or unsaturated. Particular examples of the fatty acid include pelargonic acid, lauric acid, palmitic acid, stearic acid, behenic acid, undecylenic acid, oleic acid, linoleic acid, linolenic acid and the like. Exemplary of the more preferable esters are partial esters of polyhydric alcohols such as oleic acid monoglyceride, oleic acid diglyceride, stearic acid monoglyceride, stearic acid diglyceride and the like.

The amount of addition of the above mentioned component (B) is from 0.005 to 5% by weight or, preferably, from 0.01 to 3% by weight. No sufficient improvement can be obtained in the friction characteristics with an amount of addition smaller than 0.005% by weight. On the other hand, the oxidation stability is undesirably affected adversely by the addition in excess of 5% by weight.

The lubricating oil composition of the present invention can be obtained basically by admixing the above described components (A) and (B) with the base oil but it is optional to add an acid amide or a boron derivative thereof with an object to improve the friction characteristics and simultaneously to enhance the physical properties as a lubricating oil. The acid amide is a reaction product of a carboxylic acid having 12 to 30 carbon atoms and an amine compound and the particular examples thereof include the reaction products of isostearic acid or oleic acid with diethylene triamine, triethylene tetramine, tetraethylene pentamine and hexaethylene pentamine and the like. And, examples of the boron-containing derivatives of an acid amide include the reaction products of an acid amide and a boron compound (boric acid, salts of boric acid and esters of boric acid). Particular examples include those obtained by the reaction of boric acid with the above mentioned acid amide, e.g., the reaction product of isostearic acid and tetraethylene pentamine. The amount of addition is 0.01 to 10% by weight or, preferably, 0.05 to 3% by weight. No sufficient improving effect of the friction characteristics and cleaning and dispersing effect can be obtained with an amount of addition smaller than 0.01% by weight while, on the other hand, addition in excess of 10% by weight is undesirable due to the decrease in the coefficient of static friction resulting in a decreased transmission torque.

To the lubricating oil composition of the present invention, if desired, an antioxidant, a detergentdispersant, a viscosity index improver and the like can be added. As the antioxidant, those commonly used such as phenol base compounds, amine base compounds and zinc dithiophosphate can be used. Representative examples are 2,6-di-tert-butyl-4-methyl-phenol; 2,6-di-tert-butyl-4-ethyl-phenol; 4,4'-methylenebis(2,6-di-tert-butyl-phenol); phenyl-α-naphthylamine, dialkyldiphenylamine, zinc di-2-ethylhexyldithiophosphate, zinc diamyldithiocarbamate, and pinene pentasulfide.

The amount of addition is 0.01 to 3% by weight or, preferably.0.05 to 2% by weight. No effect can be obtained with an amount smaller than 0.01% by weight while no remarkable improvement can be achieved even with an amount in excess of 3% by weight.

Detergent-dispersants which can be used include an ashless base dispersant and a metal-based detergent. For example, alkenylsuccinic acid imide, sulphonates and phenates are preferred. Representative examples of such preferred compounds are polybutenylsuccinic acid imide, calcium sulphonate, barium sulphonate, calcium phenate, barium phenate and calcium salicylate.

The amount of addition is 0.1 to 10% by weight or, preferably, 0.5 to 5% by weight. The dispersibility is insufficient with an amount smaller than 0.1% by weight while an amount in excess of 10% by weight is undesirable due to the decrease in the friction characteristics.

Though not particularly limitative, polymethacrylates, copolymers of olefin and the like can be used as the viscosity index improver. Particularly preferable are the polymethacrylates having a molecular weight not exceeding 100,000 or, preferably, not exceeding 50,000 having excellent shearing stability and capable of preventing any viscosity changes over a long period of time. The amount of addition is 0.5 to 15% by weight or, preferably, 2 to 10% by weight. No improvement can be achieved in the viscosity-temperature characteristics with an amount smaller than 0.5% by weight, while an amount in excess of 15% by weight is undesirable due to the decrease in the wearing resistance and the like as a result of the use of a low-viscosity base oil.

Besides, the lubricating oil composition of the present invention can be admixed according to need with a corrosion inhibitor, rubber swelling agent, defoaming agent and the like.

In the following, the present invention is described in more detail by way of examples.

EXAMPLES 1 and 2 and COMPARATIVE EXAMPLES 1 and 2

As a base oil, a mineral oil I having a kinematic viscosity of 5 centistokes at 100° C. and containing 200 ppm of sulfur was admixed with 4.0% by weight of a polymethacrylate (molecular weight 42,000), 4.0% by weight of polybutenyl succinic acid imide (molecular weight of the polybutenyl group 1000) and 0.5% by weight of an acid amide to give a base oil which was admixed with a compound in an amount indicated in Table 1 to give a lubricating oil composition.

The thus obtained lubricating oil composition was subjected to testing according to the following methods.

SAE No. 2 friction test

The friction characteristics were evaluated under the experimental conditions described below by using a SAE No. 2 testing machine manufactured by Greening Co. (U.S.).

Experimental Conditions

Discs: Japanese-made paper-based discs for automatic transmission (2 sheets)

Plates: Japanese-made steel plates for automatic transmission (4 plates)

Revolution of motor: 3000 rpm

Thrusting pressure on piston: 3 kg/cm$^2$

Oil temperature: 50° C., 80° C., 100° C. and 120° C.

The coefficient of dynamic friction at the revolution of 1200 rpm $\mu_{1200}$ and the coefficient of static friction at a moment of coming into stoppage $\mu_0$ were determined under the above described experimental conditions and $\mu_0/\mu_{1200}$ was calculated. The change in time and the change by temperature of this $\mu_0/\mu_{1200}$ were respectively determined to evaluate the friction characteristics.

Namely, the change in time of $\mu_0/\mu_{1200}$ was determined up to 2000 cycles at an oil temperature of 100° C. FIG. 1 illustrates the change in time of $\mu_0/\mu_{1200}$ at the respective moments up to 2000 cycles (100, 200, 300, 400, 500, 1000, 1500 and 2000 cycles). Further, the values of $\mu_0/\mu_{1200}$ at 200 cycles and at 2000 cycles are shown in Table 1 as the results of the *durability test.*

Figure 2:
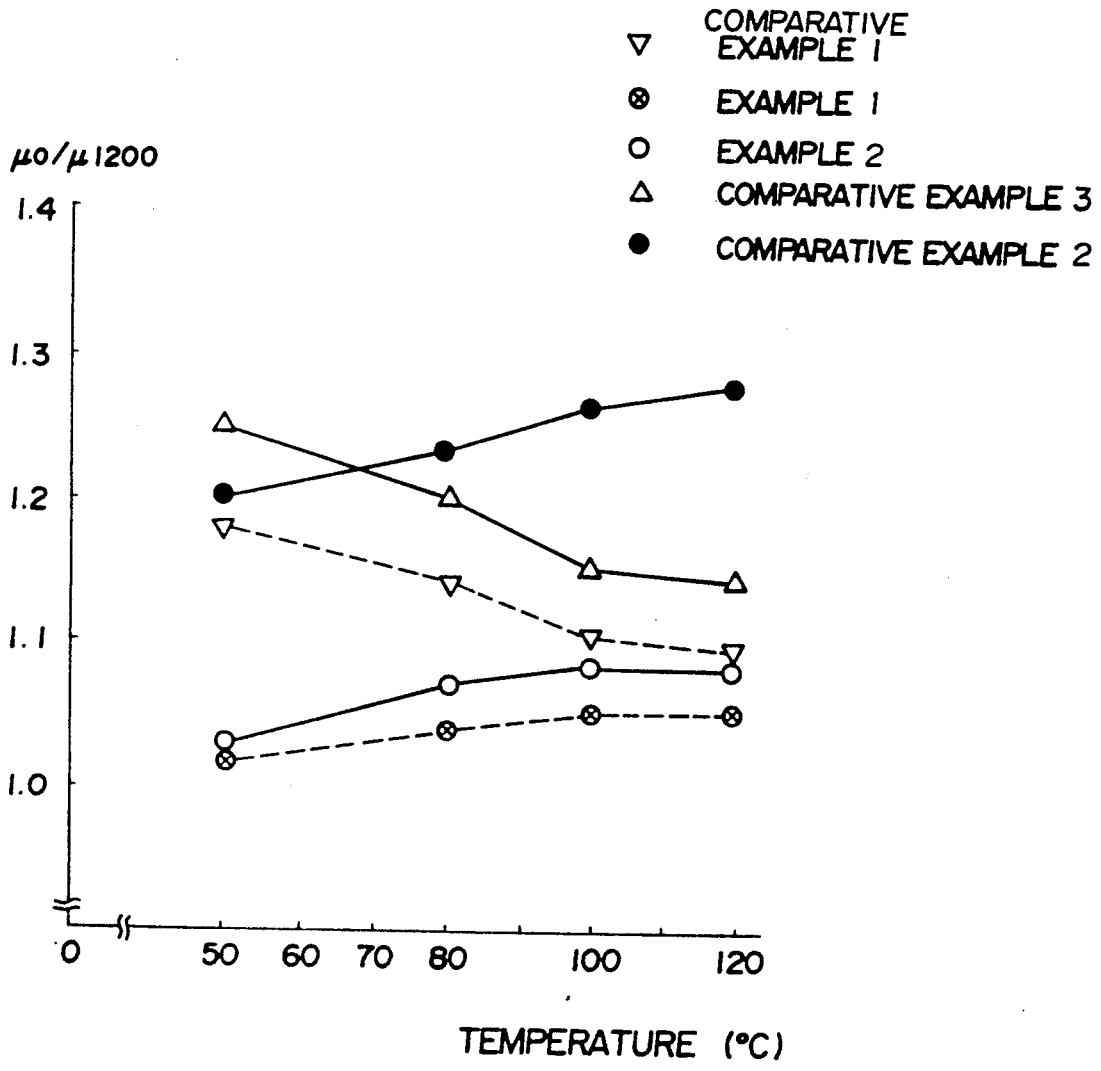

In the next place, the oil temperature was varied stepwise at 50, 80, 100 and 120° C. after a break-in up to 200 cycles at an oil temperature of 100° C. and the $\mu_0/\mu_{1200}$ was determined at each temperature. The results are shown in FIG. 2. Further, the values of $\mu_0/\mu_{1200}$ at 50° C. and 120° C. are shown in Table 1 as the results of the *temperature dependency test.*

Comparative Example 3

A commercial product was subjected to the evaluation of the friction characteristics in the same manner as in Example 1. The results are shown in Table 1, FIG. 1 and FIG. 2.

EXAMPLES 3 and 4 and COMPARATIVE EXAMPLE 4

Figure 3:
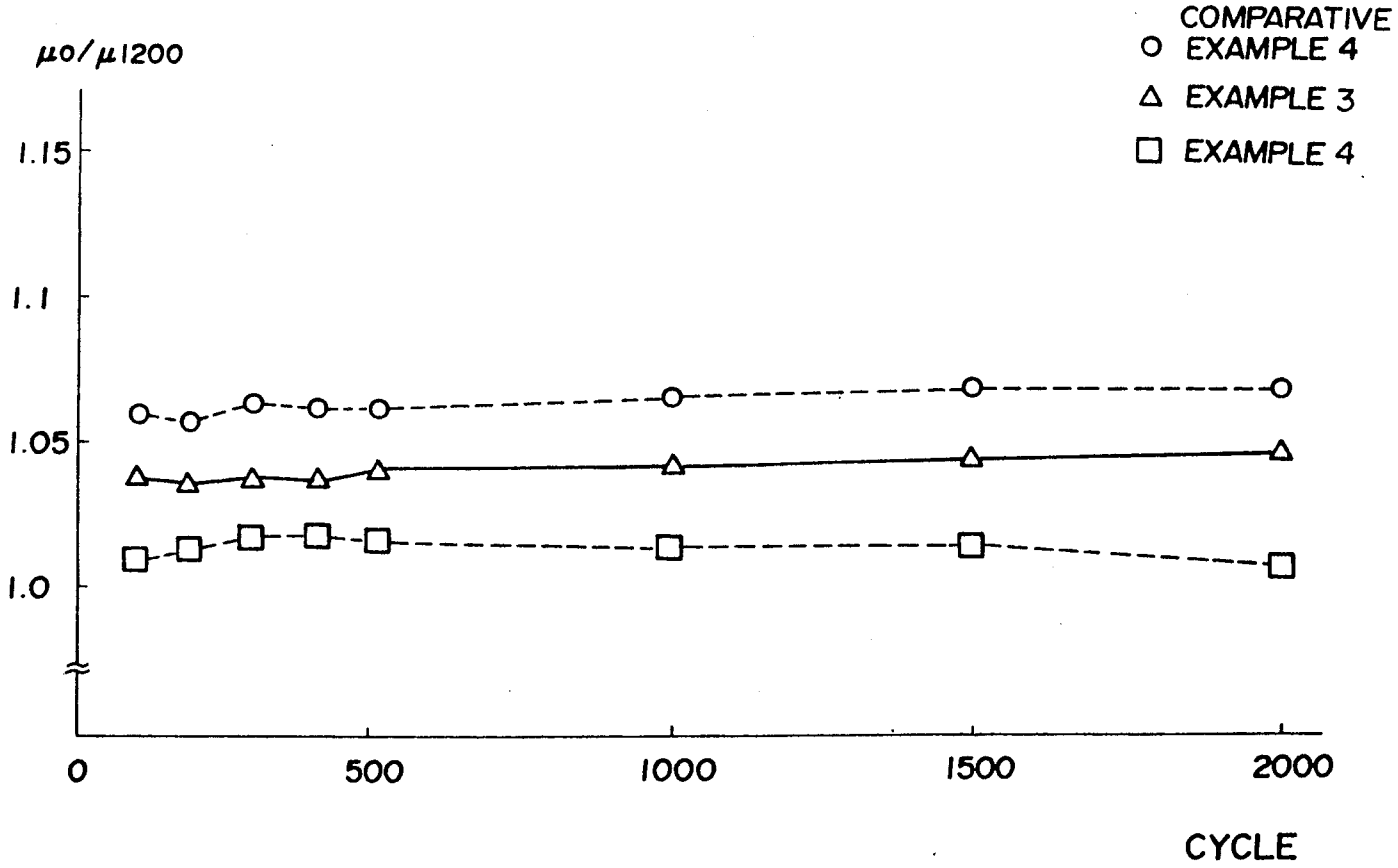

The lubricating oil compositions indicated in Table 1 were obtained in the same manner as in Examples 1 and 2 and Comparative Examples 1 and 2 excepting the use of a mineral oil II having following properties as the base oil and testing was undertaken. FIG. 3 shows the changes in time of the $\mu_0/\mu_{1200}$ at the respective moments up to 2000 cycles. Further, Table 1 shows the results of the durability test and the temperature dependency test.

| Properties of the mineral oil II | |
|---|---|
| Kinematic viscosity (100° C.) | 5.0 centistokes |
| Sulfur content (ppm) | 1 |
| Pour point | −45° C. |
| % $C_A$ | 0.1> |

EXAMPLES 5 to 10 and COMPARATIVE EXAMPLE 5

Testing was undertaken for the lubricating oil compositions indicated in Table 1 in the same manner as in Examples 1 and 2 and Comparative Examples 1 and 2. Table 1 shows the results of the durability test and the temperature dependency test. Incidentally, the base oil was admixed, in the same manner as in Examples 1 and 2 and Comparative Examples 1 and 2 (in the same manner as in the other Examples and Comparative Examples) with 4.0% by weight of a polymethacrylate (molecular weight 42,000), 4.0% by weight of a polybutenyl succinic acid imide (molecular weight of the polybutenyl group 1000) and 0.5% by weight of an acid amide.

TABLE 1

| | Base Oil | | Component A (% by weight) | | | Component B (% by weight) | | Durability Test | | Temperature Dependency Test | |
|---|---|---|---|---|---|---|---|---|---|---|---|
| | Type *1 | % by weight | $A_1$ *2 | $A_2$ *3 | $A_3$ *4 | $B_1$ *5 | $B_2$ *6 | 200 cycle | 2000 cycle | 50° C. | 120° C. |
| Comparative Example 1 | Mineral Oil I | 99.0 | 1.0 | — | — | — | — | 1.09 | 1.10 | 1.18 | 1.09 |
| Example 1 | Mineral Oil I | 98.5 | 1.0 | — | — | 0.5 | — | 1.05 | 1.06 | 1.02 | 1.05 |
| Example 2 | Mineral Oil I | 98.5 | 1.0 | — | — | — | 0.5 | 1.08 | 1.09 | 1.03 | 1.08 |
| Comparative Example 2 | Mineral Oil I | 99.5 | — | — | — | — | 0.5 | 1.26 | 1.21 | 1.20 | 1.27 |
| Comparative Example 3 | Commercial Product | | | | | | | 1.14 | 1.16 | 1.25 | 1.14 |
| Comparative Example 4 | Mineral Oil II | 99.0 | 1.0 | — | — | — | — | 1.06 | 1.07 | 1.16 | 1.06 |
| Example 3 | Mineral Oil II | 98.5 | 1.0 | — | — | 0.5 | — | 1.03 | 1.04 | 1.02 | 1.04 |
| Example 4 | Mineral Oil II | 98.5 | 1.0 | — | — | — | 0.5 | 1.01 | 1.01 | 1.02 | 1.02 |
| Example 5 | Mineral Oil I | 98.5 | — | 1.0 | — | 0.5 | — | 1.04 | 1.05 | 1.03 | 1.05 |
| Example 6 | Mineral Oil II | 98.5 | — | 1.0 | — | 0.5 | — | 1.02 | 1.03 | 1.02 | 1.03 |
| Example 7 | Synthetic Oil III | 98.5 | 1.0 | — | — | — | 0.5 | 1.09 | 1.10 | 1.05 | 1.09 |
| Example 8 | Synthetic Oil III | 98.5 | — | 1.0 | — | — | 0.5 | 1.09 | 1.10 | 1.04 | 1.08 |
| Example 9 | Synthetic Oil IV | 98.5 | — | 1.0 | — | 0.5 | — | 0.99 | 1.00 | 0.98 | 1.00 |
| Comparative Example 5 | Mineral Oil I | 99.0 | — | 1.0 | — | — | — | 1.08 | 1.09 | 1.19 | 1.09 |
| Example 10 | Mineral Oil I | 98.5 | — | — | 1.0 | 0.5 | — | 1.05 | 1.05 | 1.03 | 1.06 |

*1 Mineral oil I: kinematic viscosity at 100° C. 5 centistokes; content of sulfur 200 ppm; pour point −17.5° C.; and % $C_A$ 6
Mineral oil II: kinematic viscosity at 100° C. 5.0 centistokes; content of sulfur (ppm) 1>; pour point −45° C.; and % $C_A$ 0.1>
Synthetic oil III: α-olefin oligomer (kinematic viscosity at 100° C. 4 centistokes)
Synthetic oil IV: 2-methyl-2,4-dicyclohexyl pentane (kinematic viscosity at 100° C. 3.7 centistokes)
*2 $A_1$: monolauryl ester of octadecenyl succinic acid
*3 $A_2$: octylmercaptan propylene oxide ester of octadecenyl succinic acid
*4 $A_3$: 5-hydroxy-3-thiapentyl ester of octadecenyl succinic acid
*5 $B_1$: oleic acid monoglyceride
*6 $B_2$: sorbitan monooleate It is understood from Table 1 and FIGS. 1 to FIG. 3 that the lubricating oil composition of the present invention has excellent friction characteristics. In particular, it is understood from the result of the temperature dependency test that the changes in the friction characteristics depending on the oil temperature are extremely small.

Industrial Utilizability

Accordingly, the lubricating oil composition of the present invention is very effective as a lubricating oil for automatic transmissions, lubricating oil for the parts having a wet-type clutch or wet-type brake in tractors and the like, and so on.

Besides, the composition having such characteristics in combination is also effective as a lubricating oil in shock absorbers, power steerings, hydrualic suspensions and the like and as a combined-use oil for a plurality of these objects.

We claim:

1. A lubricating oil composition comprising (1) a lubricating base oil, (2) component (A) from 0.05 to 5% by weight of and ester of an alkenyl substituted succinic acid and/or an ester of an alkyl substituted succinic acid, wherein said ester of said alkyl substituted succinic acid and said ester at said alkyl substituted succinic acid have the formula $$R^1-\underset{\underset{CH_2-COOR^3}{|}}{CH}-COOR^2$$

wherein $R^1$ is an alkenyl group or an alkyl group of 6 to 30 carbon atoms; $R^2$ and $R^3$ are each hydrogen, an alkyl group of 1 to 20 carbon atoms, a hydroxyalkyl group of 1 to 20 carbon atoms or a group of the formula $$-R^4-(OR^4)_n-S_x-R^5$$

wherein $R^4$ is an alkylene group of 1 to 4 carbon atoms, $R^5$ is an alkyl group of 1 to 20 carbon atoms or a hydroxy-substituted group thereof, n is an integer of 0 to 6 and x is 1 or 2, and $R^2$ and $R^3$ are the same or different, provided that both $R^2$ and $R^3$ may not be hydrogen and (3) component (B) from 0.05 to 5% by weight of a fatty acid partial ester of a polyhydric alcohol.

2. The lubricating oil composition of claim 1 wherein the base oil contains 0.5% by weight or less of sulfur.

3. The lubricating oil composition of claim 1, wherein said component (B) is a fatty acid partial ester of glycerin, trimethylol propane, pentaerythritol or sorbitol, and said fatty acid is a saturated or unsaturated fatty acid containing 8 to 30 carbon atoms.

4. The lubricating oil composition of claim 3, wherein said component (A) is in an amount from 0.1 to 3% by weight and said component (B) is in an amount of from 0.01 to 3% by weight.

5. The lubricating oil composition of claim 4, wherein said lubricating base oil has a viscosity of 1.5 to 30 centistokes at 100° C. and said lubricating composition is an automatic transmission lubricating composition.

6. The lubricating oil composition of claim 5, wherein said lubricating base oil has a viscosity of from 2 to 20 centistokes at 100° C.

7. The lubricating oil composition of claim 6, wherein said lubricating base oil contains 0.1% by weight or less of sulfur.

8. The lubricating oil composition of claim 7, wherein said lubricating base oil contains 100 ppm or less of sulfur.

9. The lubricating oil composition of claim 3, wherein in component (A) $R^1$ is an alkenyl group or an alkyl group containing 12 to 24 carbon atoms and in said component (B) said fatty acid is selected from the group consisting of pelargonic acid, lauric acid, palmitic acid, stearic acid, behenic acid, undecylenic acid, oleic acid, linoleic acid and linolenic acid.

10. The lubricating oil composition of claim 9, wherein said component (B) is selected from the group consisting of oleic acid monoglyceride, sorbitan monooleate, oleic acid diglyceride, stearic acid monoglyceride and stearic acid diglyceride.

11. The lubricating oil composition of claim 10, wherein said component (A) is in an amount from 0.1 to 3% by weight and said component (B) is in an amount from 0.01 to 3% by weight.

12. The lubricating oil composition of claim 11, wherein component (A) is selected from the group consisting of monomethyl ester of octadecenyl succinic acid, dimethyl ester of octadecenyl succinic acid, monoethyl ester of octadecenyl succinic acid, diethyl ester of octadecenyl succinic acid, monooctyl ester of octadecenyl succinic acid, dioctyl ester of octadecenyl succinic acid, monononyl ester of octadecenyl succinic acid, dinonyl ester of octadecenyl succinic acid, monolauryl ester of octadecenyl succinic acid, dilauryl ester of octadecenyl succinic acid, monolauryl ester of dodecyl succinic acid, dilauryl ester of dodecyl succinic acid, monomethyl ester of hexadecyl succinic acid, dimethyl ester of hexadecyl succinic acid, monoethyl ester of hexadecyl succinic acid, diethyl ester of hexadecyl succinic acid, monomethyl ester of octadecyl succinic acid, dimethyl ester of octadecyl succinic acid, monoethyl ester of octadecyl succinic acid, diethyl ester of octadecyl succinic acid, monooctyl ester of octadecyl succinic acid, dioctyl ester of octadecyl succinic acid, monolauryl ester of octadecyl succinic acid, monolauryl ester of octadecyl succinic acid, dilauryl ester of octadecyl succinic acid, a reaction product of an alkenyl succinic acid of a propylene oligomer having 18 carbon atoms and a propylene glycol, a reaction product of a polybutenyl succinic acid of a polybutene having an average molecular weight of 400 and a propylene glycol, octyl mercaptan ethylene oxide ester of octadecenyl succinic acid, octyl mercaptan propylene oxide ester of octadecenyl succinic acid, nonyl mercaptan ethylene oxide ester of octadecenyl succinic acid, nonyl mercaptan propylene oxide ester of octadecenyl succinic acid, lauryl mercaptan ethylene oxide ester of octadecenyl succinic acid, lauryl mercaptan propylene oxide ester of octadecenyl succinic acid, 5-hydroxy-3-thiapentyl ester of octadecenyl succinic acid and 6-hydroxy-3,4-dithiahexyl ester of octadecenyl succinic acid.

13. The lubricating oil composition of claim 11, wherein said component (A) is selected from the group consisting of monolauryl ester of octadecenyl succinic acid, octylmercaptan propylene oxide ester of octadecenyl succinic acid and 5-hydroxy-3-thiapentyl ester of octadecenyl succinic acid and said component (B) is selected from the group consisting of oleic acid monoglyceride and sorbitan monooleate.

14. The lubricating oil composition of claim 13, wherein the base oil is selected from the group consisting of 60 neutral oil, 100 neutral oil, 150 neutral oil, 300 neutral oil and 500 neutral oil, polyolefins, esters of dibasic acids, polyol esters, phosphoric acid esters, silicone oils, alkyl benzenes and alkyl diphenyls.

15. The lubricating oil composition of claim 13, wherein the base oil is a mineral oil having a pour point of −15° C. or below, a content of aromatic hydrocarbons (percent CA) of 20 or smaller and a total acid value of 0.1 mg KOH/g or smaller.

16. The lubricating oil composition of claim 13, wherein the base oil is a mineral oil having a pour point of −25° C. or below, a content of aromatic hydrocarbons (percent CA) of 10 or smaller and a total acid value of 0.05 mg KOH/g or smaller.

17. The lubricating oil composition of claim 13, wherein the base oil is a synthetic oil selected from the group consisting of 2-methyl-2,4-dicyclohexyl pentane, cyclohexyl methyl decalin, 1-(methyl decalyl)-1-cyclohexyl ethane, 2,4-dicyclohexyl pentane and isododecyl cyclohexane.

18. The lubricating oil composition of claim 13, wherein said lubricating base oil has a viscosity of 1.5 to 30 centistokes at 100° C. and said lubricating composition is an automatic transmission lubricating composition.

19. The lubricating oil composition of claim 18, wherein said lubricating base oil has a viscosity of from 2 to 20 centistokes at 100° C.

20. The lubricating oil composition of claim 19, wherein said lubricating base oil contains 0.1% by weight or less of sulfur.

21. The lubricating oil composition of claim 20, wherein said lubricating base oil contains 100 ppm or less of sulfur.

22. The lubricating oil composition of claim 1, wherein $R^1$ is an alkenyl group or an alkyl group having 12 to 24 carbon atoms.

23. The lubricating oil composition of claim 1, further comprising a carboxylic acid amide having 12 to 30 carbon atoms or a boron-containing derivative thereof.

24. The lubricating oil composition of claim 23, wherein the acid amide is a reaction product of isostearic acid or oleic acid with diethylene triamine, triethylene tetramine, tetraethylene pentamine or hexaethylene pentamine.

25. The lubricating oil composition of claim 23, wherein the acid amide is in an amount of 0.01 to 10 weight %.

26. The lubricating oil composition of claim 1, further including one or more of an antioxidant, a detergent-dispersant and a viscosity index improver.

27. A method of lubricating a wet-type clutch or a wet-type brake in an agricultural tractor comprising applying to said clutch or said brake an effective amount of the lubricating oil composition of claim 1.

28. The lubricating oil composition of claim 1, wherein the lubricating base oil is a synthetic oil.

29. The lubricating oil composition of claim 28, wherein the synthetic oil is selected from the group consisting of esters of dibasic acids and polyol esters.

30. A lubricating oil composition comprising (1) a lubricating base oil, (2) component (A) from 0.05 to 5% by weight of an ester of an alkenyl substituted succinic acid and/or an ester of an alkyl substituted succinic acid, wherein said ester of said alkenyl substituted succinic acid and said ester of said alkyl substituted succinic acid have the formula

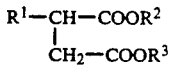

wherein $R^1$ is an alkenyl group or an alkyl group of 6 to 30 carbon atoms; $R^2$ and $R^3$ are each hydrogen, an alkyl group of 1 to 20 carbon atoms, a hydroxyalkyl group of 1 to 20 carbon atoms and $R^2$ and $R^3$ are the same or different, provided that both $R^2$ and $R^3$ may not be hydrogen and (3) component (B) from 0.005 to 5% by weight of a fatty acid partial ester of a polyhydric alcohol, wherein said lubricating base oil is (i) a mineral oil having a pour point of −25° C. or below, a content of aromatic hydrocarbons (percent $C_A$) of 10 or smaller and a total acid value of 0.05 mg KOH/g or smaller or (ii) a synthetic oil selected from the group consisting of 2-methyl-2,4-dicyclohexyl pentane, cyclohexyl methyl decalin, 1-(methyl decalyl)-1-cyclohexyl ethane, 2,4-dicylcohexyl pentane and isododecyl cyclohexane.

* * * * *